US011464085B2

(12) United States Patent
Carlsson et al.

(10) Patent No.: US 11,464,085 B2
(45) **Date of Patent: *Oct. 4, 2022**

(54) MICROWAVE HEATING APPARATUS

(71) Applicant: WHIRLPOOL CORPORATION, Benton Harbor, MI (US)

(72) Inventors: Hakan Carlsson, Norrkoping (SE); Ulf Nordh, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 487 days.

This patent is subject to a terminal disclaimer.

(21) Appl. No.: 16/534,410

(22) Filed: Aug. 7, 2019

(65) Prior Publication Data

US 2019/0364622 A1 Nov. 28, 2019

Related U.S. Application Data

(63) Continuation of application No. 15/137,305, filed on Apr. 25, 2016, now Pat. No. 10,390,387, which is a (Continued)

(30) Foreign Application Priority Data

Jun. 18, 2012 (EP) ..... 12172328

(51) Int. Cl.
*H05B 6/68* (2006.01)
*H05B 6/64* (2006.01)
(Continued)

(52) U.S. Cl.
CPC ..... *H05B 6/682* (2013.01); *H05B 6/6447* (2013.01); *H05B 6/664* (2013.01); *H05B 6/666* (2013.01); *H05B 6/68* (2013.01); *H05B 6/705* (2013.01)

(58) Field of Classification Search
CPC ..... H05B 6/6447; H05B 6/664; H05B 6/666; H05B 6/68; H05B 6/682; H05B 6/705
(Continued)

(56) References Cited

U.S. PATENT DOCUMENTS 4,079,221 A 3/1978 McGillem et al.
4,210,795 A 7/1980 Lentz
(Continued)

FOREIGN PATENT DOCUMENTS

EP 2326141 A1 5/2011
FR 2766272 A1 1/1999
WO 200008897 A3 2/2000

OTHER PUBLICATIONS

European Patent Application No. 121723282.1 filed Jun. 18, 2012, Applicant: Whirlpool Corporation. Extended European search report re: same, dated Oct. 19, 2012.

*Primary Examiner* — Quang T Van
(74) *Attorney, Agent, or Firm* — McGarry Bair PC

(57) ABSTRACT

An apparatus and a method for heating a load using microwaves is disclosed. The apparatus includes a transmission line, configured to transmit microwaves from a microwave generator to a cavity. A sensing device configured to measure a standing wave for providing information about the phase and the amplitude of a reflection coefficient that represents a ratio between the amount of microwaves reflected back towards the microwave generator and the amount of microwaves transmitted in the transmission line from the microwave generator. A control unit configured to detect whether the measured standing wave correspond to a reflection coefficient having a phase within a certain interval of phases and an amplitude within a certain interval of amplitudes. Additionally, certain intervals of phases and amplitudes correspond to an operating region of the micro-
(Continued)

wave generator. The control unit controls feeding of microwaves to the cavity based on this detection.

20 Claims, 5 Drawing Sheets

Related U.S. Application Data continuation of application No. 13/920,408, filed on Jun. 18, 2013, now Pat. No. 9,363,852.

(51) Int. Cl.
*H05B 6/70* (2006.01)
*H05B 6/66* (2006.01)

(58) Field of Classification Search
USPC ..... 219/709, 702, 704, 705, 710, 720, 739, 219/741, 742, 747, 750, 753, 764, 778, 219/780; 324/95, 645; 700/299
See application file for complete search history.

(56) References Cited

U.S. PATENT DOCUMENTS

| | | | | |
|---|---|---|---|---|
| 4,507,530 | A | 3/1985 | Smith | |
| 5,079,507 | A | 1/1992 | Ishida et al. | |
| 5,300,901 | A | 4/1994 | Krummel et al. | |
| 6,242,726 | B1 | 6/2001 | Harris et al. | |
| 8,338,763 | B2 | 12/2012 | Nordh et al. | |
| 9,363,852 | B2 * | 6/2016 | Carlsson | H05B 6/6447 |
| 10,390,387 | B2 * | 8/2019 | Carlsson | H05B 6/666 |
| 2012/0249165 | A1 * | 10/2012 | Mcerlean | A61B 18/1815 324/642 |

* cited by examiner

MICROWAVE HEATING APPARATUS

CROSS REFERENCE TO RELATED APPLICATIONS

This application is a continuation of U.S. application Ser. No. 15/137,305 filed Apr. 25, 2016, now issued as U.S. Pat. No. 10,390,387, issued on Aug. 20, 2019, which is a continuation of U.S. application Ser. No. 13/920,408 filed Jun. 18, 2013, now issued as U.S. Pat. No. 9,363,852, issued on Jun. 7, 2016, which claims the priority of European Application Serial No. 12172328.2, filed Jun. 18, 2012, all of which are incorporated herein by reference in their entirety.

TECHNICAL FIELD

The present disclosure relates to the field of microwave heating, and in particular to a method and a microwave heating apparatus for heating a load by means of microwaves.

BACKGROUND

A microwave heating apparatus, such as a microwave oven, usually comprises a cooking chamber (or cavity) in which a load, such as a food item, may be placed to be heated. The microwave oven further comprises a microwave generator, such as e.g. a magnetron, for generating microwaves and a transmission line for transmitting the microwaves to the cavity.

In a microwave oven, the operating region of the microwave generator may depend on the type of load placed in the cavity. Certain operating regions, which may e.g. deteriorate the microwave generator, are preferably avoided. For this purpose, during the design of a microwave oven, a set of different standard loads is tested and the design of the microwave oven is adjusted, in particular its feeding system, for avoiding operation of the microwave generator in such operating regions. However, such a procedure is time consuming and, regardless of the number of standard loads tested during design, the likelihood of a customer finding a load not comprised in the set of standard loads is not negligible, thereby causing the risk of shortening the lifetime of the microwave generator (and thereby the microwave oven as a whole) or even of directly deteriorating the microwave generator.

Thus, there is a need for providing alternatives and/or new microwave heating apparatus that would overcome such drawbacks.

SUMMARY

An object of at least some aspects of the present disclosure is to provide a more efficient alternative to the above technique and prior art. In particular, it is an object of at least some of the aspects of the present disclosure to provide a microwave heating apparatus with longer lifetime. The present disclosure relates also to the corresponding method for heating a load using microwaves.

This and further objects of the present disclosure are achieved by means of a microwave heating apparatus and a method having the features defined in the independent claims. Preferable aspects of the disclosure are characterized by the dependent claims.

According to a first aspect of the present disclosure, there is provided A microwave heating apparatus includes a cavity arranged to receive a load, a microwave generator arranged to generate microwaves, a transmission line arranged to transmit the generated microwaves to the cavity, a sensing device arranged to measure a standing wave in the transmission line and configured to provide information about the phase and the amplitude of a reflection coefficient, the reflection coefficient being representative of the ratio between the amount of microwaves reflected back towards the microwave generator and the amount of microwaves transmitted in the transmission line from the microwave generator, and a control unit configured to detect whether the measured standing wave corresponds to a reflection coefficient having a phase within a predetermined interval of phases and an amplitude within a predetermined interval of amplitudes, said predetermined intervals of phases and amplitudes corresponding to an operating region of the microwave generator, and to control the microwave generator based on the detection.

According to a second aspect of the present disclosure, there is provided a method of heating a load in a cavity using microwaves transmitted in a transmission line from a microwave generator, the method comprising the steps of: measuring a standing wave for providing information about the phase and the amplitude of a reflection coefficient, the reflection coefficient being representative of the ratio between the amount of microwaves reflected back towards the microwave generator and the amount of microwaves transmitted in the transmission line from the microwave generator, detecting whether the measured standing wave correspond to a reflection coefficient having a phase within a predetermined interval of phases and an amplitude within a predetermined interval of amplitudes, said certain intervals of phases and amplitudes corresponding to an operating region of the microwave generator, and controlling the microwave generator based on the detection.

The present disclosure makes use of an understanding that measuring standing wave or standing wave strength may provide information about the phase and the amplitude of a reflection coefficient being representative of the ratio between the amount of microwaves reflected back towards the microwave generator and the amount of microwaves transmitted in the transmission line from the microwave generator, and that control of feeding of microwaves to the cavity may be based on a detection whether the measured standing wave correspond to a reflection coefficient having a phase within a certain interval of phases and an amplitude within a certain interval of amplitudes. These certain intervals of phases and amplitudes correspond to an operating region of the microwave generator.

The present disclosure is advantageous in that it provides a microwave heating apparatus in which, thanks to information about the phase and the amplitude of the reflection coefficient obtained from the measured electromagnetic field strengths, the microwave generator may be operated in a more efficient and/or more desirable operating region, e.g. in terms of protection of the microwave generator.

The amplitude of the reflection coefficient indicates the amount of microwaves generated by the microwave generator that is reflected back towards the microwave generator. A low amplitude of the reflection coefficient indicates that most of the generated microwaves is not reflected back towards the microwave generator and, thus, is absorbed by (most probably) the load, i.e. that heating of the load is efficient, while a high amplitude indicates that a substantial portion of the generated microwaves is not absorbed by (most probably) the load and instead reflected back towards the microwave generator, i.e. that heating is less efficient. A substantial portion of the generated microwaves being reflected back towards the microwave generator may also affect the microwave generator or other parts of the microwave heating apparatus. In particular, the reflected microwaves may deteriorate the filament of the magnetron, which may directly or over time damage the magnetron.

The phase of the reflection coefficient may indicate the sensitivity of the microwave heating apparatus to high reflection (i.e. high amplitude of the reflection coefficient). Indeed, a certain amplitude may be undesirable (or even unacceptable) for some phases, but may be acceptable for other phases. Hence, the present disclosure is advantageous in that information about both the amplitude and the phase of the reflection coefficient is considered.

The microwaves generated by, and transmitted from, the microwaves generator and the microwaves reflected back towards the microwave generator together typically form a standing wave in the transmission line. The phase of the reflection coefficient may indicate where the maxima and minima of the standing wave are located between the cavity and the microwave generator. The location of these maxima may determine to which extent the reflected microwaves may affect the microwave generator and other parts of the microwave heating apparatus. In particular, a high amplitude of the reflection coefficient (e.g. a high amount of reflected microwaves) may be less desirable for some phases at which the standing wave maxima are located in certain sensitive areas, while the same amplitude may be acceptable in combination with other phases corresponding to other locations of these maxima.

The performance of the microwave generator may depend on the reflection coefficient (and thereby on the load). For example, the frequency and/or the amplitude of the generated microwaves may change if the reflection coefficient changes. The properties (e.g. frequency and amplitude) of the generated microwaves may be more sensitive to changes for some phases and/or amplitudes of the reflection coefficient. Hence, information about the phase and the amplitude of the reflection coefficient may be used during operation of the microwave heating apparatus to determine whether the microwave generator is in a state (or operating region) in which it is sensitive to changes in the load.

As described above, properties of the microwave generator such as efficiency, sensitivity to changes in the load or risk of being affected by reflected microwaves may be associated with certain phases and/or amplitudes of the reflection coefficient. Hence, the present disclosure is advantageous in that it associates an operating region of the microwave generator to a certain interval of phases and a certain interval of amplitudes of a reflection coefficient corresponding to (or, in some aspects, as derived from) measured electromagnetic field strengths.

The present disclosure is advantageous in that the control unit may detect whether the measured electromagnetic field strengths (providing information about phase and amplitude) correspond to the microwave generator being in a certain operating region, and may control the feeding of microwaves to the cavity based on such detection. Indeed, it may be advantageous to control feeding of microwaves to the cavity differently, or in any case provide some actions, if it is detected that the microwave generator is in a certain operating region. As a result, heating efficiency may be improved and/or the lifetime of the microwave generator may be extended.

Control of the feeding of microwaves to the cavity is advantageously based on information about the phase of the reflection coefficient. Employing a control policy of the feeding based solely on the amplitude of the reflection coefficient may be inefficient since such a control policy may require actions to be taken if it is detected that amplitude of the reflection coefficient exceeds a threshold, regardless of the fact that for some phases of the reflection coefficient, amplitudes above the threshold may still be acceptable.

The sensing device may be arranged to measure electromagnetic field strengths in the transmission line, such as the field strengths of a standing wave present in the transmission line. The sensing device (or measuring equipment) may comprise a number of detectors. The sensing device may comprise a unit for collecting the measurements and, in some aspects, the sensing device may comprise a processor for processing the measurements. In some aspects, the sensing devise may be an integrated part of the control unit. The electromagnetic field strengths measured by the sensing device may e.g. be electric field strengths and/or voltages.

The reflection coefficient carries information about the total load of the microwave heating apparatus (seen or experienced by the microwave generator), i.e. the transmission line, the coupling of the transmission line to the cavity (i.e. a feeding port), the cavity with its interior (e.g. the walls of the cavity), and the load, such as a food item placed in the cavity. Microwaves generated by the microwave generator may be transmitted in the transmission line to the cavity. The transmission line, the coupling to the cavity, the cavity with its interior, and the load may not absorb all the transmitted microwaves, thereby resulting in an amount of microwaves reflected back towards the microwave generator. The transmitted microwaves and the reflected microwaves may be represented by complex numbers and the ratio between these two numbers may be represented by a reflection coefficient having an amplitude and a phase. The amplitude may be the ratio between the strength (or field strength/power/energy) of the microwaves transmitted in the transmission line and the strength (or field strength/power/energy) of the microwaves reflected back towards the microwave generator.

The phase may correspond to a distance from a reference plane in the transmission line to the first field strength minimum/maximum (of a standing wave) in the transmission line. This distance may be measured in terms of a wavelength $\lambda_g$, i.e. the wavelength of the microwaves in the transmission line. The standing wave present in the transmission line has a period which is equal to $\lambda_g/2$. Hence, the phase of the reflection coefficient may have values between 0 and $\lambda_g/2$. Alternatively, the phase of the reflection coefficient may be expressed in terms of angles such that distances from 0 to $\lambda_g/2$ corresponds to angles from e.g. 0 to 360 degrees or 0 to $2\pi$ radians, respectively. It will be appreciated that 0 and $\lambda_g/2$ may represent the same phase.

When generating microwaves, which are to be transmitted by the transmission line to the cavity in order to heat a load, the microwave generator experiences an impedance caused by the transmission line, the coupling of the transmission line to the cavity, the cavity itself and its interior, including the load (e.g. a food item). This impedance may be referred to as a complex impedance in that it may comprise a real part (resistance) and an imaginary part (reactance). The complex impedance may provide more or less the same information as the reflection coefficient. The phase and the amplitude of the reflection coefficient may e.g. be obtained from the complex impedance.

Information about the phase and the amplitude of the reflection coefficient received by the control unit from the sensing device may for example be the values of the measured electromagnetic field strengths or any other information which may be derived from these values, such as e.g.

the complex impedance described above. Further, the control unit may be configured to derive the necessary information about the phase and the amplitude of the reflection coefficient from the measured electromagnetic field strengths.

In one aspect, the control unit may be adapted to use the measured electromagnetic field strengths as such and for instance compare the values of the measured electromagnetic field strengths with reference values of a look-up table, or any other storage means or memory in which reference values for a number of operating regions of the microwave generator are stored. The control unit may be configured to determine a current operating region of the microwave generator (i.e. detect whether the working point or operating point of the microwave generator is in a particular operating region as defined by the intervals of phases and amplitudes), or to directly obtain feeding instructions, based on such comparison. For this purpose, the look-up table may comprise the feeding instructions corresponding to the values of the measured electromagnetic field strengths.

In another aspect, the control unit may be configured to determine the phase and the amplitude of the reflection coefficient, or the complex impedance, from the measured electromagnetic field strengths. Alternatively, the control unit may directly receive the phase and the amplitude of the reflection coefficient (or any other intermediate information such as the complex impedance) from the sensing device.

The control unit may therefore comprise a processor for processing the received information (or received values of the measured electromagnetic field strengths) in order to compute the phase and the amplitude of the reflection coefficient or the complex impedance. The control unit may then be adapted to determine whether the computed values of the amplitude and the phase of the reflection coefficient, or the real part and imaginary part of the complex impedance, are associated with a particular operating region of the microwave generator. In such cases, the microwave heating apparatus may comprise a memory or look-up table in which a number of different feeding instructions may be stored for various values of the amplitude and the phase of the reflection coefficient or for various complex impedances. The control unit may be adapted to select a suitable feeding instruction in accordance with such look-up table. The look-up table or memory may be part of the control unit or a separate unit.

Further, it will be appreciated that the control unit may be a separate unit or an integrated part of the sensing device.

According to an aspect, there may exist a plurality of operating regions of the microwave generator corresponding to respective certain intervals of phases and certain intervals of amplitudes. A plurality of operating regions of the microwave generator may correspond to different regions, each region being defined by the combination of a certain interval of phases and a certain interval of amplitudes. The control unit may then be adapted to detect whether the measured electromagnetic field strengths correspond to a reflection coefficient having a phase and an amplitude within one of these regions and to control feeding of microwaves to the cavity accordingly. In this respect, it will be appreciated that, in some aspects, the present disclosure may be implemented in a microwave heating apparatus with the definition of a single region, in which case actions to be taken are defined if the microwave generator is detected to operate in such single region (i.e. if the microwave generator is detected to operate in such a particular operating region). In other aspects, the present disclosure may be implemented in a microwave heating apparatus with the definition of a plurality of regions, in which case actions may have to be taken if the microwave generator is detected to operate in some of these regions and no action needs to be taken for other regions. Further, the type of actions to be taken may vary from one region to another.

According to an aspect, the control unit may be configured to, in response to a detection that the measured electromagnetic field strengths correspond to a reflection coefficient having a phase within the certain interval of phases and an amplitude within the certain interval of amplitudes, alter the feeding of the microwaves via control of parameters relating to the microwave generator and/or to the transmission line. In the present aspect, the feeding of microwaves may be altered (or adjusted) once it is detected that the microwave generator is in the operating region, which may be some time after the microwave generator enters the operating region or even already when it enters the operating region, depending on the periodicity at which the measurements are performed. The control unit may be configured to control the sensing device such that it performs measurements on a regular basis, e.g. with a certain time interval, or on the basis of a random time schedule, as appropriate. If it is detected that the measured electromagnetic field strengths correspond to a reflection coefficient corresponding to the operating region, the feeding will be adjusted accordingly. The operating region may be a condition or state in which the heating process is efficient and in which the microwave generator is safely operated, in which case no specific action needs to be taken. However, the operating region may advantageously be a condition or state for which actions need to be taken in order to operate the microwave heating apparatus in a more efficient manner and/or operate the microwave generator in a more cautious way. For simplicity, the following aspects are mainly described with reference to detection of operation of the microwave generator in a single operating region, which is a particular operating region for which actions need to be taken.

The feeding may for example be adjusted via control of parameters of the microwave generator, such as the anode current in the case of a magnetron, or via control of the transmission line, such as adjustment of a movable or adjustable impedance tuner (e.g. a capacitive post) in the transmission line. As a result, the heating process becomes more efficient or better suited for the microwave generator. A certain feeding policy may be employed if it is detected that the microwave generator operates in the particular operating region (as defined by the certain intervals of phases and amplitudes), which may not be suitable otherwise.

Alternatively or additionally, the control unit may be configured to measure a time during which the measured electromagnetic field strengths correspond to reflection coefficients having phases within the certain interval of phases and amplitudes within the certain interval of amplitudes. The control unit may be adapted to alter the feeding of the microwaves via control of parameters relating to the microwave generator and/or to the transmission line on a condition that the measured time exceeds a time limit. The present aspect is advantageous in that the microwave generator may be in an operating region (corresponding to the certain intervals of phases and amplitudes) only temporarily due to a number of reasons such as e.g. a certain duty cycle used to operate the microwave generator, the effect of a rotating turntable on which the load is placed within the cavity, or a sudden change in state of the load (e.g. from frozen to thawed) or the change of operative parameters according to a selected cooking program. If the microwave generator is in the particular operating region only temporarily or briefly, there may be no need (or no benefit) to take any actions and/or to start a special feeding routine/policy and the feeding may not be modified. However, if the microwave generator is detected to operate in the particular operating region for a sufficiently long period (i.e. a period longer than the time limit), it may be advantageous to switch the feeding routine (or feeding policy).

The time during which the measured electromagnetic field strengths correspond to reflection coefficients having phases within the certain interval of phases and amplitudes within the certain interval of amplitudes may be measured during a single visit (in such a defined operating region), or it may be the accumulated time of several visits (in such a defined operating region) during the heating procedure. The time may also be the total time of visits in the particular operating region during a defined period such as during a number of seconds or minutes.

According to an aspect, the control unit may be configured to alter the feeding of microwaves by altering (or adjusting) the power output of the microwave generator, e.g. by reducing an anode current and/or altering a duty cycle for operating the microwave generator in case the microwave generator is a magnetron. In one scenario, in which the operating region may imply a risk for the microwave generator to be deteriorated by the reflected microwaves (i.e. when the operating point of the microwave generator is detected to be in such an operating region), the power output of the microwave generator may advantageously be reduced to lower the power of the reflected microwaves. Similarly, the average power of reflected microwaves may be reduced by altering a duty cycle used for operating the microwave generator. In another scenario, in which the operating region may not necessarily imply any risk of deterioration for the microwave generator, the power may be increased or kept constant.

The duty cycle used for operating the microwave generator may be controlled by the control unit directly or via a dedicated duty cycle controller.

According to an aspect, the control unit may be configured to alter the feeding of the microwaves by deactivating the microwave generator. In the present aspect, the operating region in which the microwave generator is detected to operate may indicate that parts of the microwave heating apparatus may become rapidly and seriously damaged and, thus, it may be desirable to switch off the microwave generator directly instead of gradually altering parameters for switching to a different operating region.

According to an aspect, the control unit may be configured to alter the feeding of the microwaves such that the phase of the reflection coefficient is shifted outside of the certain interval of phases and/or such that the amplitude of the reflection coefficient is shifted outside of the certain interval of amplitudes. In the present aspect, shifting of the phase and/or the amplitude of the reflection coefficient (by e.g. altering parameters of the transmission line or by altering the power output of the microwave generator) outside of the certain intervals defining the particular operating region (indicating e.g. that the microwave generator is operated in an undesired way) is used to achieve a desired operating region.

According to an aspect, the microwave generator may be a magnetron and the operating region of the magnetron, to which the certain intervals of phases and amplitudes correspond, is one of the group comprising sink phase and anti-sink phase.

The sink phase corresponds to an operating region in which the magnetron operates efficiently, e.g. the output power level of the magnetron is high relative to the anode current supplied to the magnetron, but does not allow high reflection.

The anti-sink phase corresponds to an operating region in which the magnetron operates inefficiently, e.g. the output power level of the magnetron is low relative to the anode current supplied to the magnetron.

According to an aspect, the microwave generator may be a magnetron and the operating region of the microwave generator, to which the certain intervals of phases and amplitudes correspond, is one of the group comprising the antenna high electric field region and the antenna high current region (which will be explained in more detail in the following with reference to e.g. FIG. 4*b*).

According to an aspect, the correspondence between the certain intervals of amplitudes and phases of the reflection coefficient and the operating region of the microwave generator is a known intrinsic characteristic of the microwave generator. For example, information about the operating region and the associated certain intervals of phases and amplitudes may be known by the magnetron manufacturer (and preferably supplied together with the magnetron) or it may be derived by test-running the magnetron. This information may then be programmed into the microwave heating apparatus (e.g. into the control unit) so that the control unit may detect whether the magnetron is in the operating region. As mentioned above, the microwave heating apparatus may for example comprise storage means, such as a memory or in the form of a look-up table, in which information about these certain intervals is stored.

The certain intervals associated with an operating region are not necessarily the same for different magnetrons. The certain intervals may be static (i.e. they may not change during use and/or may not be different depending on parameters of the microwave heating apparatus such as e.g. anode current to the magnetron) or may change during use, depending on different parameters of the microwave heating apparatus, such as e.g. the anode current of the magnetron. In case the correspondence between an operating region and the intervals of amplitudes and phases may vary during use, information about the possible locations of the intervals for different parameters may be programmed in advance into the microwave heating apparatus or stored in a storage means such as a memory or a look-up table.

According to an aspect, the certain interval of amplitudes may be defined by amplitude values below a tolerance level, and the control unit may be adapted to deactivate the microwave generator on a condition that the measured electromagnetic field strengths correspond to a reflection coefficient having an amplitude above the tolerance level. The present aspect is advantageous in that, regardless of the definition of a particular operating region relative to amplitudes and phases of reflection coefficients, if the reflection coefficient has an amplitude above the tolerance level, the control unit is configured to deactivate the microwave generator. The present aspect is advantageous in that it further improves the protection of the microwave generator.

According to an aspect, the sensing device may be arranged to measure the electromagnetic field strengths at different positions along the transmission line. These positions may preferably be selected such that the measured field strengths provide information about the phase and the amplitude of the reflection coefficient. These positions may advantageously be at least four and spaced from each other along the transmission line. For example, the spacing between two adjacent positions may approximately be equal to $\lambda_g/8+n\times\lambda_g/2$, wherein $\lambda_g$ is the wavelength of the microwaves in the transmission line, and n is an integer.

As will be further illustrated in the following, it may be advantageous to place the measurement positions at distances corresponding to approximately an eight of the wavelength of the generated microwaves, i.e. at a distance from each other equal to the wavelength divided by eight.

Magnetrons are typically configured to generate microwaves at a single frequency. With reference to the wavelength $\lambda_g$ of the microwaves in the transmission line, two adjacent positions for the measurements may be separated by $\lambda_g/8$.

As mentioned above, the spacing between the measurement positions is preferably equal to approximately an eighth of the wavelength of the microwaves generated by the microwave generator.

The signal provided by electromagnetic field strengths measured along the transmission line is periodic with a period equal to half of the wavelength of the transmitted microwaves. Hence, it will be appreciated that the measurement positions may be translated along the transmission line by e.g. $\lambda_g/2$, $2\times\lambda_g/2$, $3\times\lambda_g/2$ or $4\times\lambda_g/2$.

The sensing device may advantageously be configured to obtain information about the phase and amplitude of the reflection coefficient using two differences, namely a first difference between the electromagnetic field strengths measured at two of the four different positions, wherein these two positions are separated along the transmission line by approximately $\lambda_g/4+n\times\lambda_g/2$, and a second difference between the electromagnetic field strengths measured at the two remaining positions.

Measuring field strengths at four positions separated by an approximate distance of $\lambda_g/8+n\times\lambda_g/2$ is advantageous in that it provides sufficient information about the phase of the reflection coefficient. In particular, from such measurements, an estimate of the reflection coefficient, or the complex impedance experienced by the microwave generator, may be derived (if necessary). For this purpose, the microwave heating apparatus may further comprise a processor (or processing means) configured to obtain a real part and an imaginary part of a complex impedance experienced by the microwave generator, the complex impedance being obtained using (from) the difference between the electromagnetic field strengths measured at two of the four different positions, these two positions being separated along the transmission line by approximately $\lambda_g/4+n\times\lambda_g/2$ ($\lambda_g$ being the wavelength of the microwaves, as defined above), and the difference between the electromagnetic field strengths measured at the remaining two positions. The Rieke diagram is a Smith chart on which contours of constant power output and constant frequency for a microwave generator (or oscillator) have been drawn. Such a diagram is used for illustrative purposed herein and other polar diagrams whose coordinates represent the components of the complex reflection coefficient at the oscillator load may be used.

The complex impedance may be illustrated as a working point in a Smith chart or corresponding Rieke diagram (further illustrated below). In the Smith chart, the x-coordinate of this working point corresponds to the difference between the electromagnetic field strengths measured at two of the four different positions as described above, and the y-coordinate corresponds to the difference between the electromagnetic field strengths measured at the remaining two positions.

The complex impedance of the load may be derived from the working point by using the special coordinate curves of the Smith chart. The real part of the impedance may be derived by following a coordinate circle of the Smith chart from the working point to the horizontal axis, while the imaginary part of the impedance may be derived by following a coordinate curve from the working point to the outer circle of the Smith chart.

The reflection coefficient may be derived from the working point by using polar coordinates in the Smith chart. The amplitude of the reflection coefficient may be derived by measuring the distance from the working point to the centre point of the Smith chart. The phase of the reflection coefficient may be derived from the angle formed between the horizontal axis and a ray from the centre point of the Smith chart passing through the working point. As mentioned above, the phase of the reflection coefficient may be measured in degrees (or radians) or it may be measured in fractions of $\lambda_g$, $\lambda_g/2$ corresponding to a full turn (360 degrees) in the Smith chart.

The microwave heating apparatus may further comprise a processor (or processing means) configured to extract the phase of the reflection coefficient using the real part and imaginary part of the complex impedance experienced by the microwave generator. Although a Smith chart may be used to illustrate aspects of the present disclosure, it will be appreciated that the processor may extract the phase and the amplitude of the reflection coefficient, or the real part and the imaginary part of the complex impedance, via other processing operations.

According to an aspect, the certain interval of phases may have a range covering or being less than $\lambda_g/2$, i.e. the certain interval of phases does not include all possible phases between 0 and $\lambda_g/2$ (or equivalently it does not include all angles between 0 and 360 degrees).

According to an aspect, the certain interval of amplitudes may extend from a value corresponding to no reflection of microwaves back towards the microwave generator to a value corresponding to full reflection of microwaves back towards the microwave generator. In the present aspect, an operating region of the microwave heating apparatus is defined to correspond to all reflection coefficients having phases in a certain interval of phases, regardless of the amplitude.

It should be noted that the processors or processing means described above in relation to the aspects of the present disclosure may be integrated in a single processor adapted to process the measured electromagnetic field strengths in accordance with any one or any combination of the preceding aspects. The processors may also be separate units, and/or at least some of the processors may be integrated with each other. At least some of the processors may be integrated parts of the sensing device, the control unit or even the storage unit.

It will be appreciated that the use of Smith charts or Rieke diagrams to derive or extract the phase and/or amplitude of the reflection coefficient and/or the complex impedance of the load, merely serves as an example for illustrative purposes. The use of Smith charts may advantageously be replaced by the use of corresponding mathematical equations known in the art, which are better suited for computations.

It will be appreciated that any of the features in the aspects described above for the microwave heating apparatus according to the first aspect of the present disclosure may be combined with the aspects of the method according to the second aspect of the present disclosure. Further objectives of, features of, and advantages with, the present disclosure will become apparent when studying the following detailed disclosure, the drawings and the appended claims. Those skilled in the art will realize that different features of the present disclosure can be combined to create aspects other than those described in the following.

BRIEF DESCRIPTION OF THE DRAWINGS

The above, as well as additional objects, features and advantages of the present disclosure, will be better understood through the following illustrative and non-limiting detailed description of preferred aspects of the present disclosure, with reference to the appended drawings, in which.

All the figures are schematic, not necessarily to scale, and generally only show parts which are necessary in order to elucidate the disclosure, wherein other parts may be omitted or merely suggested.

DETAILED DESCRIPTION

Figure 1:
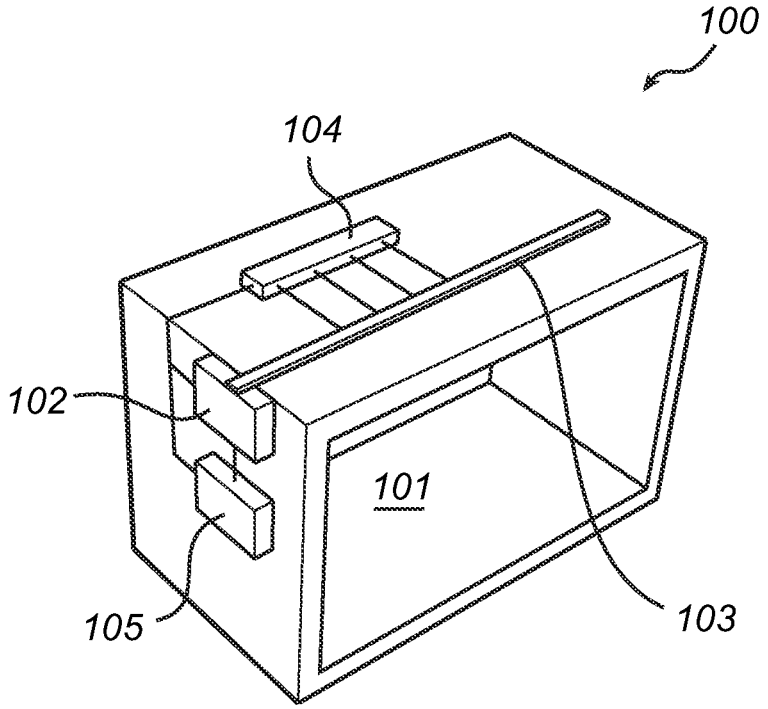
FIG. 1 is a schematic perspective view of a microwave heating apparatus according to an aspect of the present disclosure.

With reference to FIGS. 1 and 3, a microwave heating apparatus 100 according to an aspect of the present disclosure will be described.

The microwave heating apparatus 100 comprises a cavity 101 arranged to receive a load, a microwave generator 102 arranged to generate microwaves and a transmission line 103 arranged to transmit the generated microwaves to the cavity 101. A sensing device 104 is arranged to measure electromagnetic field strengths for providing information about the phase and the amplitude of a reflection coefficient being representative of the ratio between the amount of microwaves reflected back towards the microwave generator 102 and the amount of microwaves transmitted in the transmission line 103 from the microwave generator 102.

The microwave heating apparatus may further comprise a control unit 105 configured to detect whether the measured electromagnetic field strengths correspond to a reflection coefficient having a phase within a certain interval of phases 304*a-d* and an amplitude within a certain interval of amplitudes 303*a-d*, wherein the certain intervals of phases and amplitudes correspond to an operating region of the microwave generator 101. The phase and the amplitude may be illustrated using a circle (or polar coordinates) with the amplitude representing a distance from the center of the circle to a working point and the phase representing an angle counted clockwise from a reference position 301 located e.g. in the upper part of the circle to the intersection of the circle with a line joining the working point and the center of the circle. Several different scales may be used to measure the amplitude. For example, the amplitude may be represented by the reflection factor $\rho$ having values between 0 and 1. Alternatively, the amplitude may be represented via the voltage standing wave ratio VSWR, which can be expressed as: $VSWR=(1+\rho)/(1-\rho)$ having values between 1 and infinity.

Figure 3A:
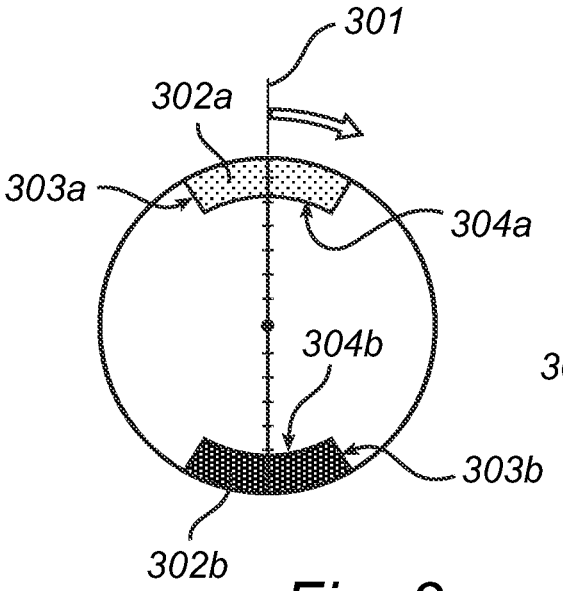
FIGS. 3*a-b* illustrate examples of certain intervals of amplitudes and phases with respect to a Smith chart.
Figure 3B:
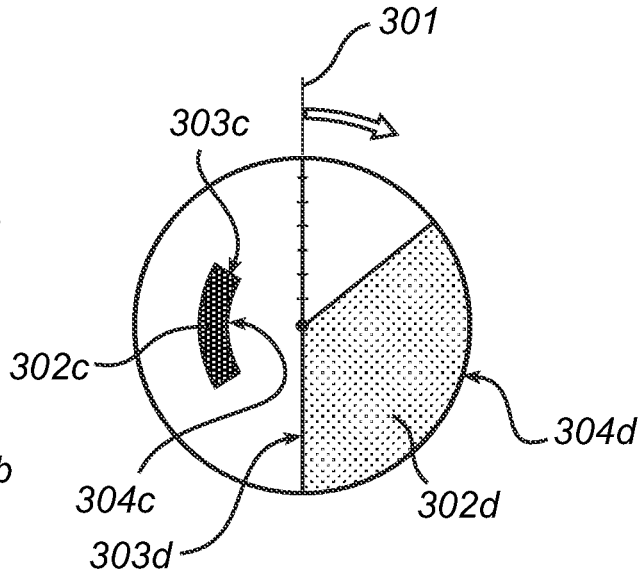

FIGS. 3*a* and 3*b* illustrate several examples of certain intervals of phases 304*a-d* and amplitudes 303*a-d*. In one example, a first region denoted 302*a* is defined by an interval of amplitudes 303*a* of the form $C<\rho<1$, where C is a positive constant, and an interval of phases 304*a* including the reference position 301 and thereby comprising two parts of the form $A<\Phi\leq\lambda_g/2$ and $0\leq\Phi<B$, where $\Phi$ is the phase and A and B are positive constants. In another example, a second region denoted 302*b* is defined by an interval of amplitudes 303*b* of the form $C<\rho<1$, where C is a positive constant and an interval of phases 304*b* of the form $A<\Phi<B$. In yet another example, a third region denoted 302*c* is defined by an interval of amplitudes 303*c* of the form $C<\rho<D$, where C and D are positive constants, and an interval of phases 304*c* still of the form $A<\Phi<B$. In yet a further example, a fourth region 302*d* is defined by an interval of amplitudes 303*d* including all possible amplitudes, i.e. of the form $0<\rho<1$, and an interval of phases still of the form $A<\Phi<B$. The region denoted 302*d* corresponds to a sector of the circle.

Figure 4A:
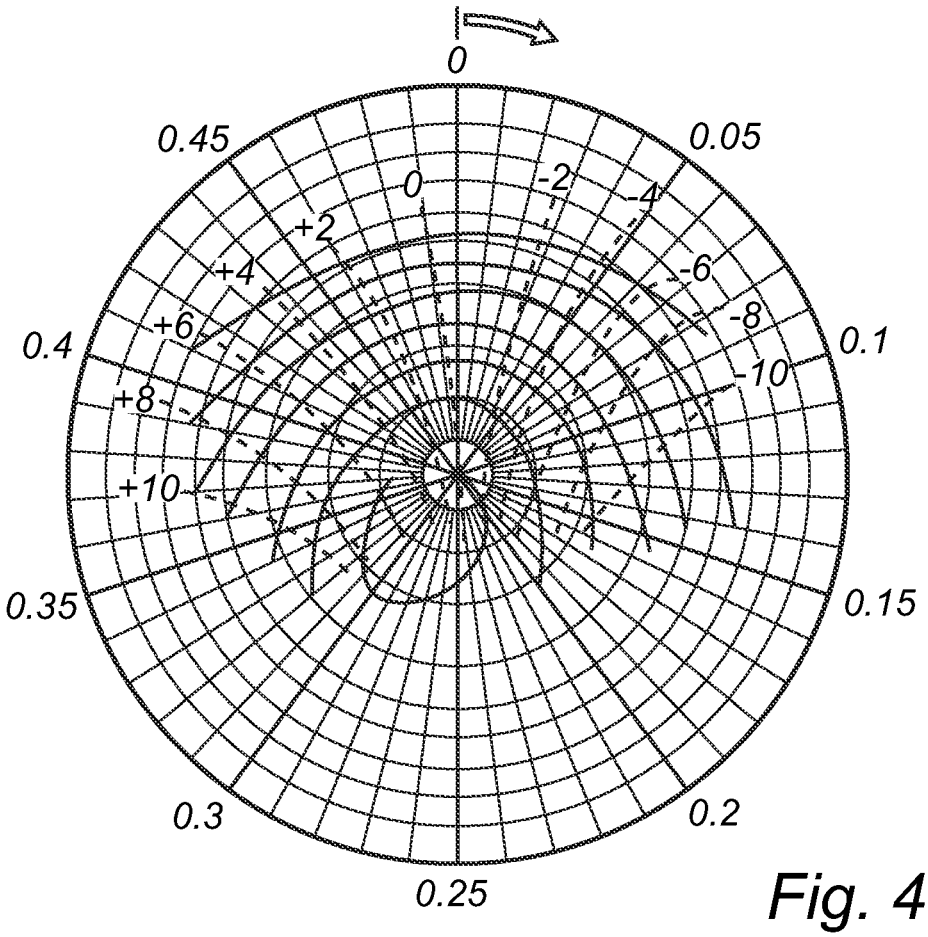
FIGS. 4*a-c* illustrate the correspondence between certain intervals of amplitudes and phases and operating regions of microwave generators in Rieke diagrams.

FIG. 4*a* is a Rieke diagram illustrating the properties of a magnetron having a nominal power of 1 kW. The Rieke diagram shows how the output power and the frequency of the generated microwaves are affected by the amplitude (represented by the voltage standing wave ratio, VSWR) and the phase of the reflection coefficient.

Figure 4B:
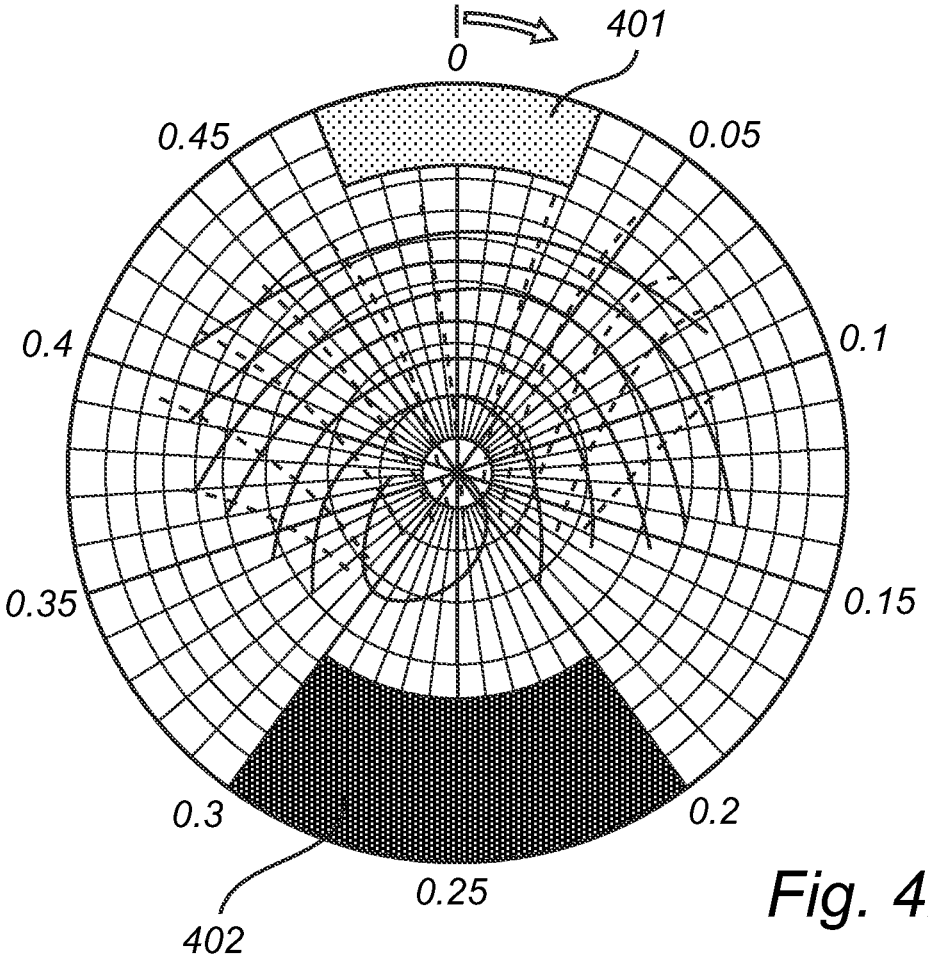

FIG. 4*b* shows the Rieke diagram of FIG. 4*a*, with two regions 401 and 402 corresponding to certain intervals of phases and amplitudes as defined in FIGS. 3*a-b*. In the present example, the region 402, located around the phase $0.25\times\lambda_g$, corresponds to a sink phase of the magnetron. The sink phase may be recognized in the Rieke diagram by a region in which the curves corresponding to constant frequency converge. In the present example, the region 401, located around the phase $0\times\lambda_g$ (i.e. around the reference plane), corresponds to an anti-sink phase of the magnetron. The anti-sink phase may be recognized in the Rieke diagram by a region in which the curves corresponding to constant frequency diverge.

More specifically, for the magnetron selected as an example here, there are three regions which may advantageously be avoided if the VSWR is larger than a threshold. The first region and the second region may be combined into a single region consisting of the high antenna current phase (phase $0.1\times\lambda_g$–$0.2\times\lambda_g$) and the sink phase ($0.2\times\lambda_g$–$0.3\times_g$). The third region is also called the thermal region (corresponding to anti-sink phase) which surrounds phase $0\times\lambda_g$ ($\sim0.47\times\lambda_g$–$0.03\times\lambda_g$ for the present example magnetron). Via dynamic impedance measurement capable of sensing if the magnetron is being operated at or above the maximum rating for the VSWR in one of these phase regions (i.e. via the electromagnetic field measurements along the transmission line), the magnetron may either be shut off or its power output be decreased.

As described above, the sink phase (electronic instability region) is defined as the phase where the frequency contours converge and the anti-sink phase (thermal region) is the phase where they diverge. It is therefore preferable to detect whether the microwave generator operate in these regions.

In addition, there are two other regions that may be of interest. Due to the fact that the magnetron reference plane is set to be coaxial with the output antenna and that phases are calculated as distances from the reference plane to the standing wave voltage minimum, the phase $0.25\times\lambda_g$ means that the voltage maximum is at the reference plane, i.e. at the antenna. This in turn means that the electric field strength at the antenna may be very large and that the magnetron may be prone to electric field breakdown, i.e. flashover at the antenna. Such an operating region or condition corresponds to the antenna high electric field region. If the electric field minimum is "moved" towards the reference plane by changing phase of the standing wave, the electric field maximum moves backward into the antenna, thereby creating conditions of very large electric field strength in the antenna, which may create overheating and, in some cases, cause the centre conductor of the antenna to melt. When the field maximum has "moved" approximately from $0.25\times\lambda_g$ to $0.1\times\lambda_g$, the maximum field strength will be at the bottom of the resonator output end space. Thus, it may be advantageous to monitor whether, for a certain level of amplitudes, the phase of the reflection coefficient is in the range of $0.1\text{-}0.3\times\lambda_g$.

It will be appreciated that different maximum values for the amplitude of the reflection coefficient may be used to define various areas or regions of interest. Different values for the maximal amplitude may be defined for different phase region. For example, the region corresponding to the sink phase usually needs lower amplitude values of the reflection coefficient than other areas. The region may be defined using logical expressions, which may be programmed into the microwave heating apparatus (e.g. in the control unit or some kind of microwave oven control system).

Figure 4C:
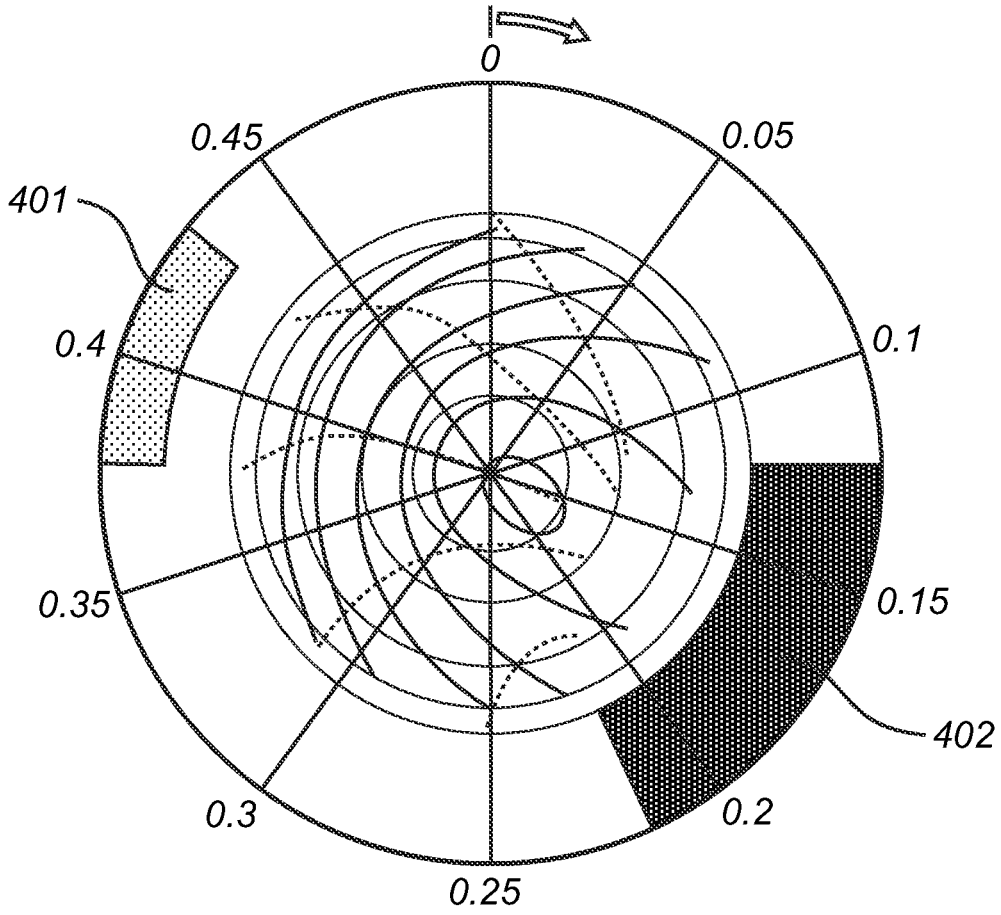

FIG. 4*c* shows a Rieke diagram for a magnetron having a higher nominal power, such as e.g. 2 kW. In the present example, the magnetron is affected somewhat differently by the reflection coefficient than the magnetron described with reference to FIG. 4*a*. Indeed, as compared to FIGS. 4*a-b*, the Rieke diagram shown in FIG. 4*c* is rotated such that the sink phase 402 is located around phase $0.17\times\lambda_g$ and the anti-sink phase 401 is located around $0.4\times\lambda_g$.

The rotation angle may be governed by the magnetron pushing factor, which relates the operating behavior and the anode current. For magnetrons intended for use in microwave ovens, the rotation may be approximately $0.05\times\lambda_g$ per 30 mA (milliamperes) of average anode current. If the average anode current is increased from its nominal value, the Rieke diagram rotates anti-clockwise and for lower current than the nominal average anode current, it rotates clockwise. Such information may be used by the control unit to locate the various operating regions of the magnetron in case the anode current is changed.

Turning back to FIG. 1, the control unit 105 may be adapted to control feeding of microwaves to the cavity 101 based on the detection whether the measured electromagnetic field strengths correspond to a reflection coefficient having a phase within a certain interval of phases 304*a-d* and an amplitude within a certain interval of amplitudes 303*a-d*.

Figure 2:
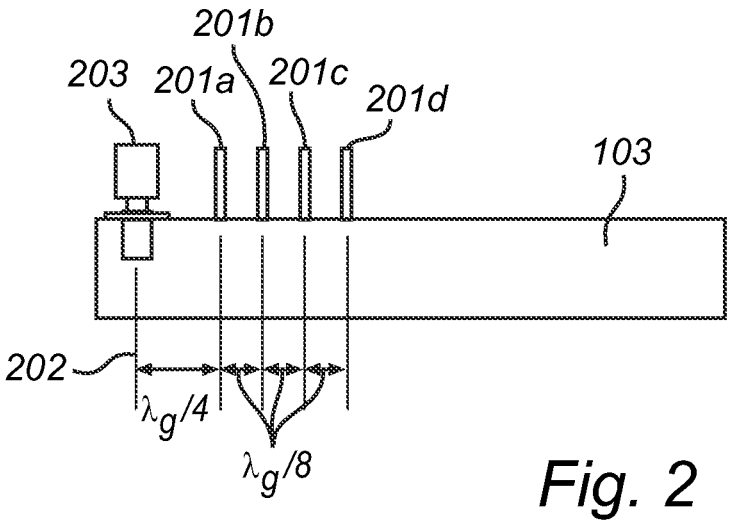
FIG. 2 illustrates a transmission line of a microwave heating apparatus in accordance with an aspect of the present disclosure.

With reference to FIGS. 1 and 2, the microwave generator 102 may be a magnetron connected to the transmission line via an antenna 203. The sensing device 104 is arranged to measure electromagnetic field strengths at four different positions 201*a-d* spaced from each other along the transmission line 103. The positions in the transmission line 103 may be measured from a reference plane 202 located at the position at which the magnetron antenna 203 enters the transmission line 103. The first position 201*a* may be located at a distance $\lambda_g/4$ from the reference plane 202, wherein $\lambda_g$ is the wavelength of the transmitted microwaves. The second position 201*b* may be located at $\lambda_g/8$ further away from the reference plane 202 and so on, the spacing between two adjacent positions (at which measurements are performed) being $\lambda_g/8$. The measured field strengths at the first 201*a*, second 201*b*, third 201*c* and fourth 201*d* positions will be referred to as Y1, X1, Y2 and X2, respectively.

The electromagnetic field strengths measured along the transmission line 103 originate from the microwaves generated by the microwave generator 102. The field strengths tend to be periodic with a periodicity being the double of the wavelength of the transmitted microwaves, i.e. periodic with the period $\lambda_g/2$. Therefore, any of the positions 201*a-d* at which the field strengths are measured may in general be translated along the transmission line 103 by e.g. $\lambda/2$, $2\times\lambda/2$, $3\times\lambda/2$ or $4\times\lambda/2$ without significantly affecting the results of the measurements.

The sensing device 104 may be configured to obtain information about the phase and amplitude of the reflection coefficient using the differences between the electromagnetic field strength measured at the first 201*a* and third 201*c* positions (i.e. Y1−Y2), and at the second 201*b* and fourth 201*d* positions (i.e. X1−X2). In an exemplifying aspect, the sensing device 104 may be configured to obtain the amplitude as $$\rho = \frac{\psi}{\psi^{inf}},$$

wherein $\psi=\sqrt{(Y1-Y2)^2+(X1-X2)^2}$ and $\psi^{inf}$ is a rescaling factor. The rescaling factor may be obtained by operating the microwave heating apparatus at full reflection, measuring field strengths $X1^{inf}$, $Y1^{inf}$, $X2^{inf}$ and $Y2^{inf}$ at the same positions 201*a-d* and calculating $\sqrt{(Y1^{inf}-Y2^{inf})^2+(X1^{inf}-X2^{inf})^2}$.

Figure 5:
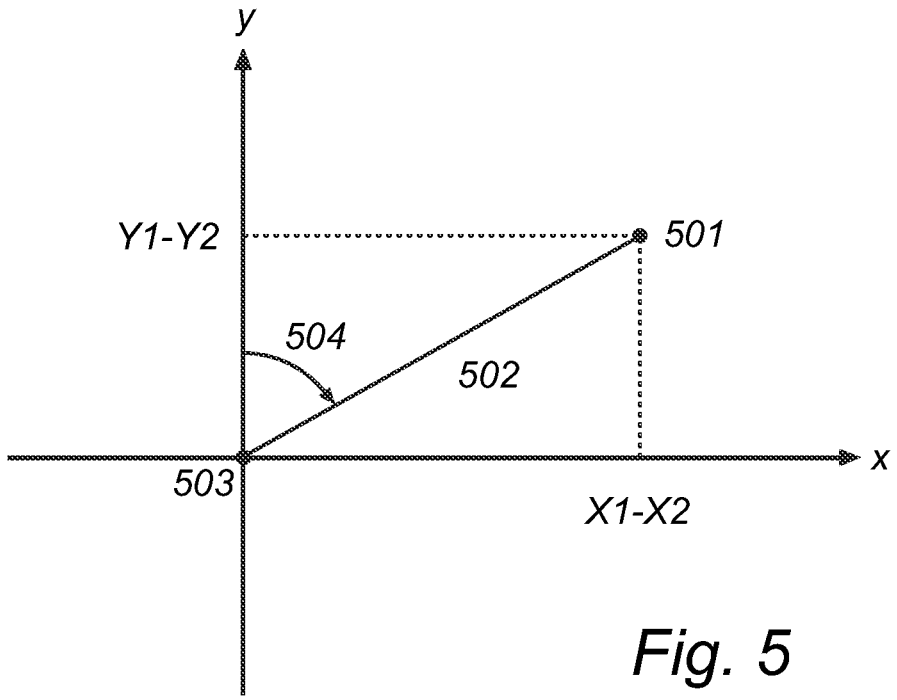
FIG. 5 illustrates the extraction of the phase of the reflection coefficient from measured electromagnetic field strengths in accordance with an aspect of the present disclosure.

Referring now to FIG. 5, as the phase of the reflection coefficient may be defined as the distance from the reference plane 202 to the first voltage minima of the standing wave in the transmission line 103, the phase may be obtained by representing the values X1−X2 and Y1−Y2 as a point 501 in a plane coordinate system (such as e.g. in a Smith chart or a Rieke diagram). The difference X1−X2 defines the x-coordinate of the working point 501 and the difference Y1−Y2 defines the y-coordinate. The phase is then obtained as the angle (from 0 to $\lambda_g/2$ corresponding to an angle between 0 and 360 degrees) counted clockwise from the y-axis to a ray 502 from the origin 503 of the coordinate system to the working point 501.

Depending on the phase of the reflection coefficient, the measurements made at the four different positions will provide field strengths as different parts of the standing wave. Table 1 lists examples where maxima (indicated by "max") and minima (indicated by "min") are located at different measurement positions. Table 1 shows coordinates achieved from measured field strengths as well as the obtained phase, for these examples.

TABLE 1

Examples of detected field strengths together with associated coordinates and phases

| 201a | 201b | 201c | 201d | x-coordinate | y-coordinate | phase |
|---|---|---|---|---|---|---|
| max | | min | | 0 | positive | 0 |
| | max | | min | positive | 0 | 0.125 |
| min | | max | | 0 | negative | 0.25 |
| | min | | max | negative | 0 | 0.375 |

Although the formulas may be different for different quadrants in the coordinate system, the angle (providing the phase of the reflection coefficient) may be calculated using trigonometry.

According to an aspect, the certain intervals of phases and amplitudes are known characteristics of the microwave heating apparatus (or microwave generator). Such known characteristics may be obtained from the supplier of the magnetron or may be measured. For example, the certain intervals and amplitudes associated with an operating region of a microwave generator may be obtained by test-running the microwave generator. Returning to FIG. 2, a capacitive post (not shown) may be introduced in the transmission line and be adjusted so that the phase and amplitude of the reflection coefficient takes different values. The output power and the frequency of the generated microwaves may be measured for different values of phases and amplitudes and a Rieke diagram may be drawn. Certain intervals of phases and amplitudes associated with for example sink and/or anti-sink phase may then be identified in the Rieke diagram.

Figure 6:
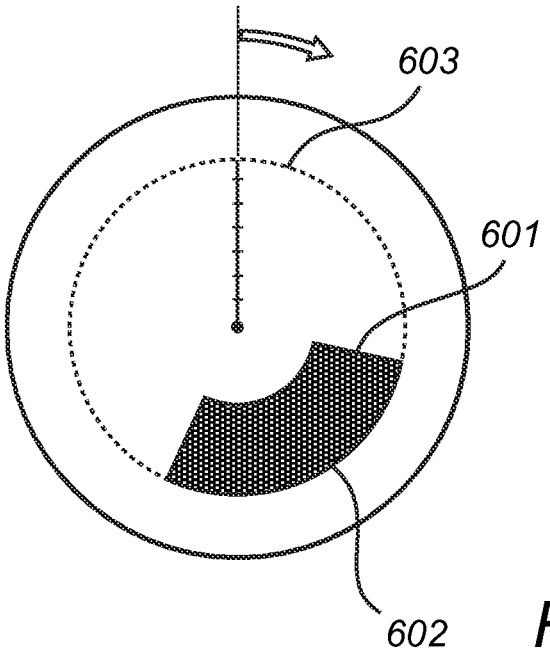
FIG. 6 illustrates the relationship between certain intervals of amplitudes and phases and an amplitude tolerance level.

FIG. 6 shows a certain interval of phases 602 and a certain interval of amplitudes 601 according to an aspect. In the present aspect, the control unit is configured to deactivate the magnetron if the amplitude is above a tolerance level 603 in order to e.g. protect the magnetron from being overheated by microwaves reflected back in the transmission line. According to the present aspect, the operating region of the magnetron to be detected, i.e. the region in the Rieke diagram in which the reflection coefficient is to be detected, may be defined by an interval of amplitudes in the form of $C<\rho<D$, with C and D being two constants, and an interval of phases in the form of $A<\Phi\leq B$, with A and B being two constants. In the present example, the operating region is defined by an interval of amplitudes being lower than the tolerance level 603 (corresponding to D in the present example). In such a microwave heating apparatus, if it is detected that the reflection coefficient is in the region as defined above, the control unit may be configured to alter parameters (e.g. by modifying a parameter of the microwave generator such as the anode current or the transmission line such as its impedance) such that the reflection coefficient is shifted outside this region, thereby avoiding the microwave generator to operate in this particular operating region. Further, the control unit may be configured to deactivate (i.e. turn off) the microwave generator if the amplitude of the reflection coefficient is detected to be above the tolerance level 603.

Figure 7:
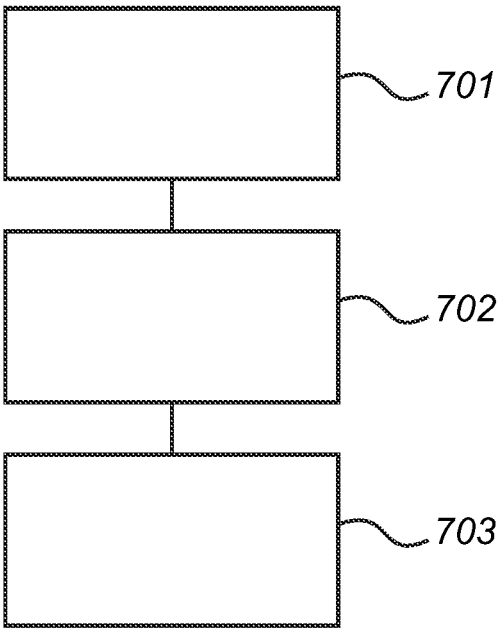
FIG. 7 shows the outline of a method of heating a load using microwaves in accordance with an aspect of the present disclosure.

With reference to FIG. 7, a method of heating a load in a cavity using microwaves transmitted in a transmission line from a microwave generator is described in accordance with an aspect of the present disclosure. The same reference numbers as for the features of the microwave heating apparatus described with reference to FIGS. 1 and 2 are used in the following.

The method comprises the steps of measuring 701 electromagnetic field strengths for providing information about the phase and amplitude of a reflection coefficient and detecting 702 whether the measured electromagnetic field strengths correspond to a reflection coefficient having a phase within a certain interval of phases and an amplitude within a certain interval of amplitudes, wherein the certain intervals of phases and amplitudes correspond to an operating region of the microwave generator 102. The method further comprises the step of controlling 703 feeding of microwaves to the cavity 101 based on the detection.

It will be appreciated that any one of the aspects described above with reference to FIGS. 1-6 is combinable and applicable to the method described herein with reference to FIG. 7.

The present disclosure is applicable for domestic appliances such as a microwave oven using microwaves for heating. The present disclosure is also applicable for heating in industrial appliances. The present disclosure is also applicable for vending machines or any other dedicated applications.

While specific aspects have been described, the skilled person will understand that various modifications and alterations are conceivable within the scope as defined in the appended claims.

For example, although the cavity may preferably be rectangular, with e.g. one or several rectangular parts, the cavity may also be cylindrical or have any other shape suitable for heating a load via microwaves.

Further, the microwave generator may be of any suitable type, such as e.g. a magnetron. The microwave heating apparatus may comprise several microwave generators of one type, or of several different types and these may be connected to the cavity by one or more transmission lines. The transmission line(s) may be at least one of a coaxial structure (such as a coaxial cable), a waveguide, a microstrip and a stripline. The microwave heating apparatus may include several transmission lines, among which some are of one type and some are of another.

Further, it will be appreciated that the positions along the transmission line, at which the electromagnetic field strengths are measured, may preferably be selected such that the measured field strengths are usable for extraction of the phase of the reflection coefficient with good accuracy. Accuracy of the phase of the reflection coefficient may depend on the positions at which the measurements are made and the accuracy of the actual values recorded during these measurements.

The invention claimed is:

1. A microwave heating apparatus comprising:

a cavity arranged to receive a load;

a microwave generator arranged to generate microwaves;

a transmission line arranged to transmit the generated microwaves to the cavity;

a sensing device arranged to measure a standing wave in the transmission line and configured to provide information about the phase and the amplitude of a reflection coefficient, the reflection coefficient being representative of the ratio between the amount of microwaves reflected back towards the microwave generator and the amount of microwaves transmitted in the transmission line from the microwave generator; and a control unit configured to detect whether the measured standing wave corresponds to a reflection coefficient having a phase within a predetermined interval of phases and an amplitude within a predetermined interval of amplitudes, said predetermined intervals of phases and amplitudes corresponding to an operating region of the microwave generator, and to control the microwave generator based on the detection.

2. The microwave heating apparatus according to claim 1, wherein the control unit is configured to, in response to the detection that the measured standing wave corresponds to a reflection coefficient having a phase within said predetermined interval of phases and an amplitude within said predetermined interval of amplitudes, alter control of parameters of the microwave generator.

3. The microwave heating apparatus according to claim 1, wherein the control unit is configured to alter control of parameters of the microwave generator on a condition that a measured time exceeds a time limit.

4. The microwave heating apparatus according to claim 2, wherein the control unit is configured to alter a duty cycle for operating the microwave generator.

5. The microwave heating apparatus according to claim 2, wherein the control unit is configured to alter parameters of the microwave generator by deactivating the microwave generator.

6. The microwave heating apparatus according to claim 1, wherein the operating region of the microwave generator, to which said predetermined intervals of phases and amplitudes correspond, is one of the group comprising sink phase and anti-sink phase, said microwave generator being a magnetron.

7. The microwave heating apparatus according to claim 1, wherein the correspondence between the predetermined intervals of amplitudes and phases of the reflection coefficient and said operating region of the microwave generator is a known intrinsic characteristic of the microwave generator.

8. The microwave heating apparatus according to claim 1, wherein the control unit is adapted to deactivate the microwave generator on a condition that the measured standing wave corresponds to a reflection coefficient having an amplitude above a tolerance level, wherein said predetermined interval of amplitudes is defined by amplitude values below the tolerance level.

9. The microwave heating apparatus according to claim 1, wherein the sensing device is arranged to measure the standing wave at different positions along the transmission line, said positions being selected such that the measured standing waves provide information about the phase and amplitude of the reflection coefficient.

10. The microwave heating apparatus according to claim 1, wherein the sensing device is arranged to measure the standing wave at least at four different positions spaced from each other along the transmission line.

11. The microwave heating apparatus according to claim 10, wherein the spacing between two adjacent positions is approximately equal to $\lambda_g/8+n\times\lambda_g/2$, wherein $\lambda_g$ is the wavelength of the microwaves in the transmission line, and n is an integer.

12. The microwave heating apparatus according to claim 11, wherein the sensing device is configured to obtain information about the phase and amplitude of the reflection coefficient using the difference between the standing waves measured at two of said four different positions, said two positions being separated along the transmission line by approximately $\lambda_g/4+n\times\lambda_g/2$, and the difference between the standing waves measured at the two remaining positions.

13. The microwave heating apparatus according to claim 12, wherein the predetermined interval of phases has a range being less than $\lambda_g/2$, wherein $\lambda_g$ is the wavelength of the microwaves in the transmission line.

14. The microwave heating apparatus according to claim 1, wherein the predetermined interval of amplitudes extends from a value corresponding to no reflection of microwaves back towards the microwave generator to a value corresponding to full reflection of microwaves back towards the microwave generator.

15. A method of heating a load in a cavity using microwaves transmitted in a transmission line from a microwave generator, the method comprising the steps of:

measuring a standing wave for providing information about the phase and the amplitude of a reflection coefficient, the reflection coefficient being representative of the ratio between the amount of microwaves reflected back towards the microwave generator and the amount of microwaves transmitted in the transmission line from the microwave generator;

detecting whether the measured standing wave corresponds to a reflection coefficient having a phase within a predetermined interval of phases and an amplitude within a predetermined interval of amplitudes, said certain intervals of phases and amplitudes corresponding to an operating region of the microwave generator; and controlling the microwave generator based on the detection.

16. The microwave heating apparatus according to claim 1, wherein the control unit is configured to measure time during a single visit in the operating region.

17. The microwave heating apparatus according to claim 1, wherein the control unit is configured to measure time accumulated during several visits in the operation region during a heating procedure.

18. The microwave heating apparatus according to claim 1, wherein the sensing device is further arranged to measure a standing wave strength in the transmission line, and wherein the control unit is further configured to detect whether the measured standing wave strength corresponds to a reflection coefficient having a phase within a predetermined interval of phases and an amplitude within a predetermined interval of amplitudes.

19. The microwave heating apparatus according to claim 18 wherein the standing wave strength corresponds to a maxima or minima of the standing wave.

20. The microwave heating apparatus according to claim 18 wherein the phase corresponds to a distance from a reference plan in the transmission line to the standing wave strength in the transmission line.

* * * * *